US009400075B1

(12) United States Patent
Miller et al.

(10) Patent No.: US 9,400,075 B1
(45) Date of Patent: Jul. 26, 2016

(54) REMOTELY ACTUATED MOORING DEVICE

(71) Applicants: Nathan T. Miller, San Diego, CA (US); Gregory W. Anderson, San Diego, CA (US); Sean Herndon, San Diego, CA (US); Charles M. Ringer, San Diego, CA (US)

(72) Inventors: Nathan T. Miller, San Diego, CA (US); Gregory W. Anderson, San Diego, CA (US); Sean Herndon, San Diego, CA (US); Charles M. Ringer, San Diego, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/679,049

(22) Filed: Apr. 6, 2015

(51) Int. Cl.
*B63B 22/02* (2006.01)
*F16L 55/00* (2006.01)
*B63B 22/00* (2006.01)

(52) U.S. Cl.
CPC ..... *F16L 55/00* (2013.01); *B63B 22/00* (2013.01); *B63B 22/02* (2013.01)

(58) Field of Classification Search
CPC ..... B63B 21/60; B63C 7/10; F42B 22/10
See application file for complete search history.

(56) References Cited

U.S. PATENT DOCUMENTS 4,119,051 A * 10/1978 Orndorff, Jr. ..... B63B 22/021 114/249
4,313,381 A * 2/1982 Tolliver ..... F42B 22/18 102/413

* cited by examiner

*Primary Examiner* — Edwin Swinehart
(74) *Attorney, Agent, or Firm* — SSC Pacific Patent Office; Arthur K. Samora; Kyle Eppele

(57) ABSTRACT

A remotely actuated fill and release device and deployment method can include a disc manifold having an upper surface, a lower surface and an outer circumferential surface. A fill passageway in the fill manifold can extend radially inward from the outer circumferential surface and can merge into a conical chamber, which can also be formed in disc manifold. The conical chamber can be formed with a maximum diameter proximate the upper surface and a minimum diameter proximate said lower surface. A release nose can be inserted into said conical chamber and fill bladder can be attached to the release nose. A FRANGIBOLT® can extend through the disc manifold and can be threaded into the release nose. A voltage can be selectively applied to the FRANGIBOLT®, which can fracture in response to the voltage, to selectively detach the release nose and fill bladder from the disc manifold without moving parts.

16 Claims, 6 Drawing Sheets

REMOTELY ACTUATED MOORING DEVICE

FEDERALLY-SPONSORED RESEARCH AND DEVELOPMENT

This invention (Navy Case No. 103411) is assigned to the United States Government and is available for licensing for commercial purposes. Licensing and technical inquires may be directed to the Office of Research and Technical Applications, Space and Naval Warfare Systems Center, Pacific, Code 72120, San Diego, Calif. 92152; voice (619) 553-5118.

FIELD OF THE INVENTION

The present invention pertains generally to mooring devices. More specifically, the present invention pertains to mooring devices for the autonomous filling, retention and selective release of a large volume inflated device, using a gas supply. The present invention is particularly, but not exclusively, useful as a mooring device which can accomplish the autonomous filling and remote release of large buoyant systems at or below the sea surface, while withstanding the resulting large tensile force which is established by filling the buoyant system, and without requiring the use of any moving parts.

BACKGROUND OF THE INVENTION

The filling of a large, moored floatation device and autonomous decoupling of the device from an umbilical fill line can require a system that can withstand high tensile loads resulting from drag and weight imparted by the mooring of a buoyant device (once filled). Design approaches in the prior art can use plug-and-socket style fill ports, with rotational actuating line releases. But these types of devices can snag or bind when subjected to loads greater than one hundred pounds force (100 lbf).

In view of the above, it can be an object of the present invention to provide a remotely actuated fill and release manifold that can withstand relatively high tensile forces once the buoyant fill bladder is filled. Another object of the present invention can be to provide a remotely actuated fill and release manifold that can allow for remote selectively release of a buoyant fill bladder from the device while the device under a relatively high tensile stress. Still another object of the present invention is to provide a remotely actuated fill and release manifold, which can allow for remote separation of the working components of the device without requiring the use of moving parts. Yet another object of the present invention to provide a remotely actuated fill and release manifold that that is easy to manufacture, that is inexpensive, and that is easy to deploy and use by remote operators in the field.

SUMMARY OF THE INVENTION

A remotely actuated fill and release device and method for deployment in accordance with several embodiments of the present invention can include a disc manifold. The disc manifold can have an upper surface, a lower surface and an outer circumferential surface. The disc manifold can also be formed with a fill passageway, which can extend radially inward from the outer circumferential surface and which can merge into a conical chamber formed in the disc manifold. The conical chamber can be formed with a maximum diameter proximate the upper surface and can taper to a minimum diameter proximate said lower surface. The conical chamber can be oriented perpendicular to the fill passageway.

A release nose can be inserted into the conical chamber, and a sacrificial fastener can fix the release nose within the conical chamber. A compressed gas supply can be connected to the fill manifold, and a fill bladder can be connected to the release nose to establish a path of fluid communication from the compressed gas supply though the disc manifold and release nose and into the fill bladder. The sacrificial fastener can be a FRANGIBOLT® that can extend through the disc manifold and that can be threaded into said release nose. A voltage supply can selectively apply a voltage to the FRANGIBOLT®, which can fracture in response to the voltage, to selectively detach the release nose from the disc manifold without using any moving parts, to thereby separate the release nose from the disc manifold and deploy the fill bladder (and associated payload, if any).

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

Figure 1:
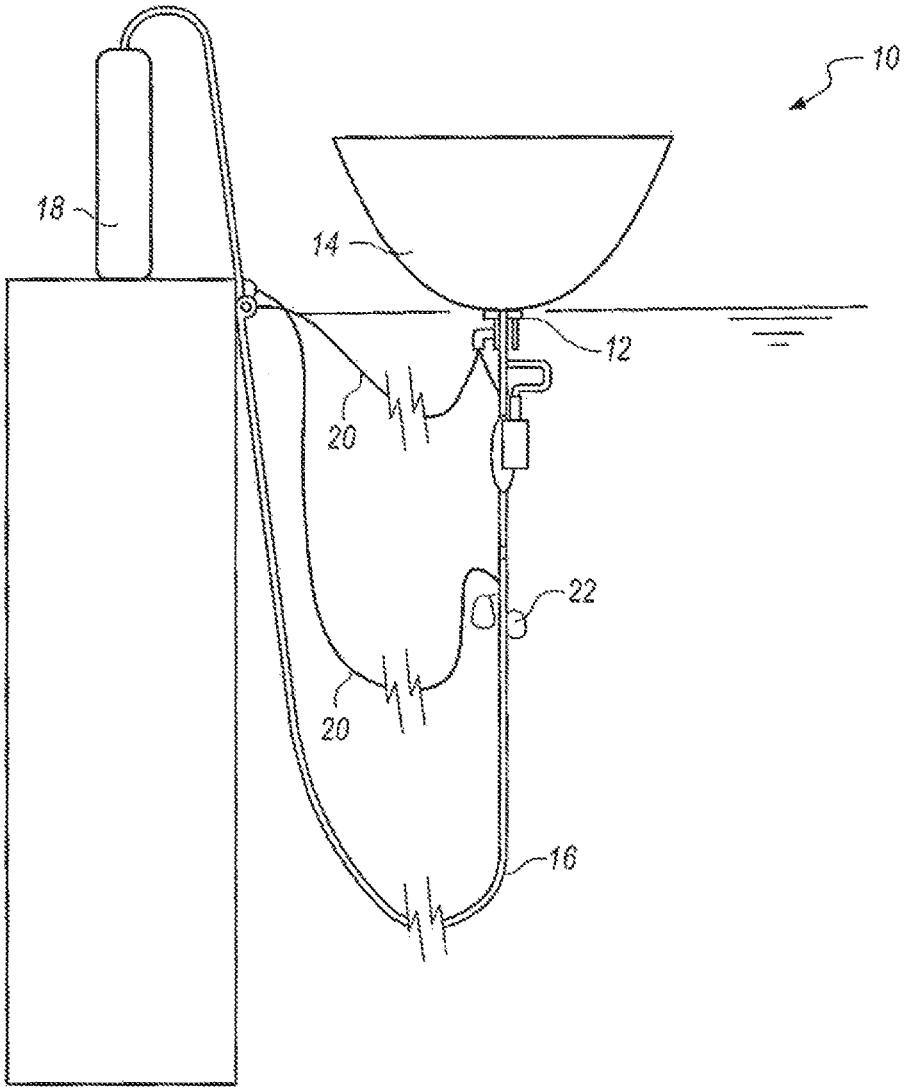
FIG. 1 is a diagram of the remotely actuated mooring device of the present invention according to several embodiments.

Referring initially to FIG. 1, a remotely actuated mooring device of the present invention according to several embodiments is shown and is generally designated by reference character 10. Device 10 can include a disc manifold 12 and a fill bladder 14. A compressed gas line 16 can connect a gas supply 18 with disc manifold 12. Device 10 can further include a recovery line 20, and ballast 22, for keeping the device 10 in place prior to and during deployment.

Figure 2:
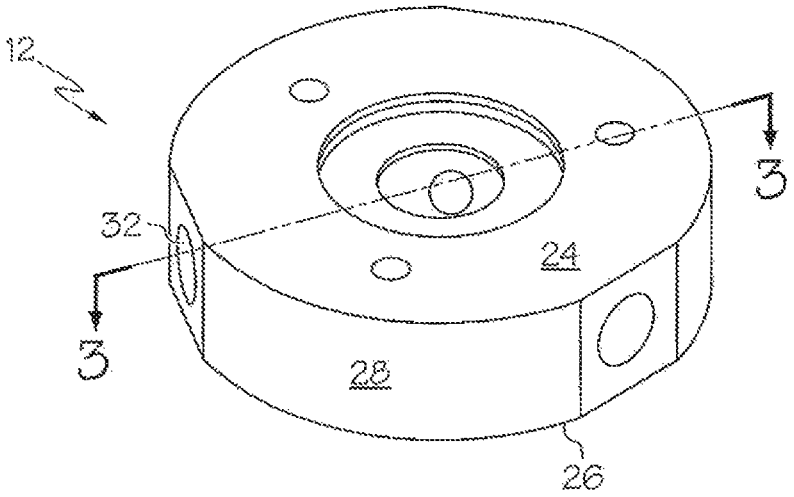
FIG. 2 an isometric view of the disc manifold for the device of FIG. 1.
Figure 3:
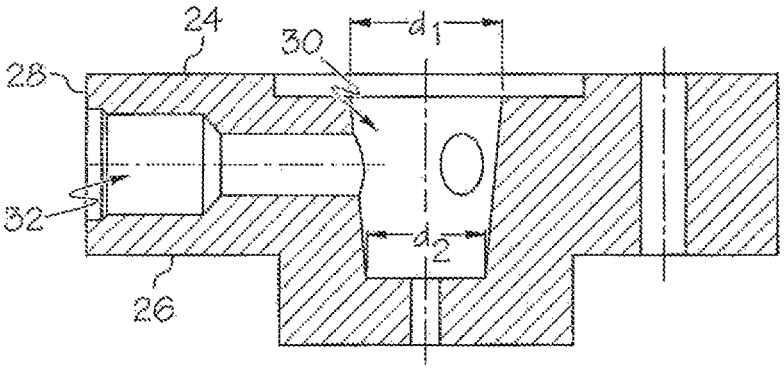
FIG. 3 is a cross-sectional view taken along line 3-3 of FIG. 2.

Referring now to FIGS. 2 and 3, the disc manifold 12 for device 10 is shown in greater detail. As shown, disc manifold 12 can have an upper surface 24 and a lower surface 26 and a circumferential surface 28. Disc manifold 12 can further be formed with a conical chamber 30, which can have a maximum diameter $d_1$ proximate upper surface 24, and which have a decreasing taper to a minimum diameter $d_2$ proximate said lower surface 26 (for illustration purposes, the taper is slightly exaggerated in FIG. 3). At least one fill passageway 32 can be formed in disc manifold 12. Fill passageway can extend radially inward from circumferential surface 28 and can merge into conical chamber 30.

Figure 4:
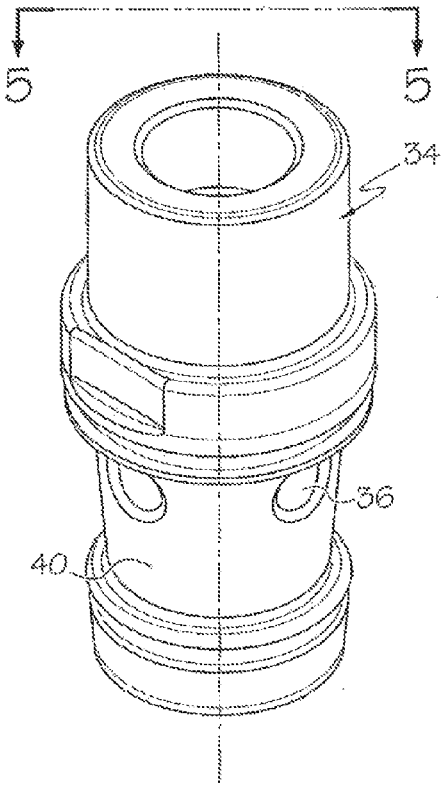
FIG. 4 is an isometric view of the release nose of the device of FIG. 1.
Figure 5:
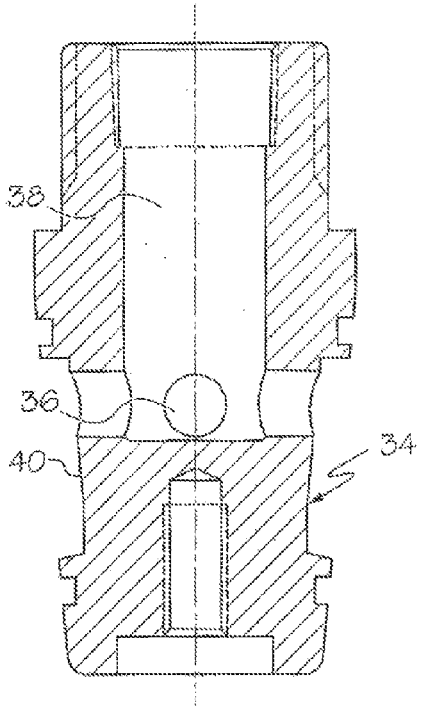
FIG. 5 is a cross-sectional view taken along line 5-5 of FIG. 4.

Referring now to FIGS. 4 and 5, the device 10 of the present invention can further include a release nose 34. Release nose 34 can be formed with at least one inflation port 36 that merges into an opening 38. Fill bladder 14 can be inserted into opening 38 and fixed to release nose 34, to allow for attachment of fill bladder 14 to the release nose. Release nose 34 can further have a mating surface 40. The conical nature of release nose 34 can provide the function of a tapered un-obstructed release while also acting as a centering and locating feature, removing side-loads on the sacrificial fastener 42.

Figure 6:
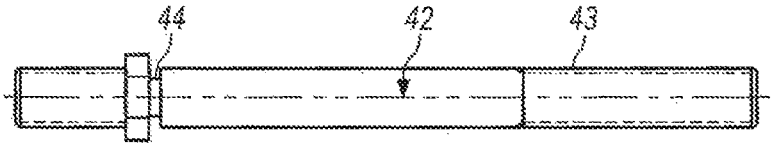
FIG. 6 is a side-elevational of a portion of the FRANGIBOLT® portion of the sacrificial fastener for the device of FIG. 1.
Figure 7:
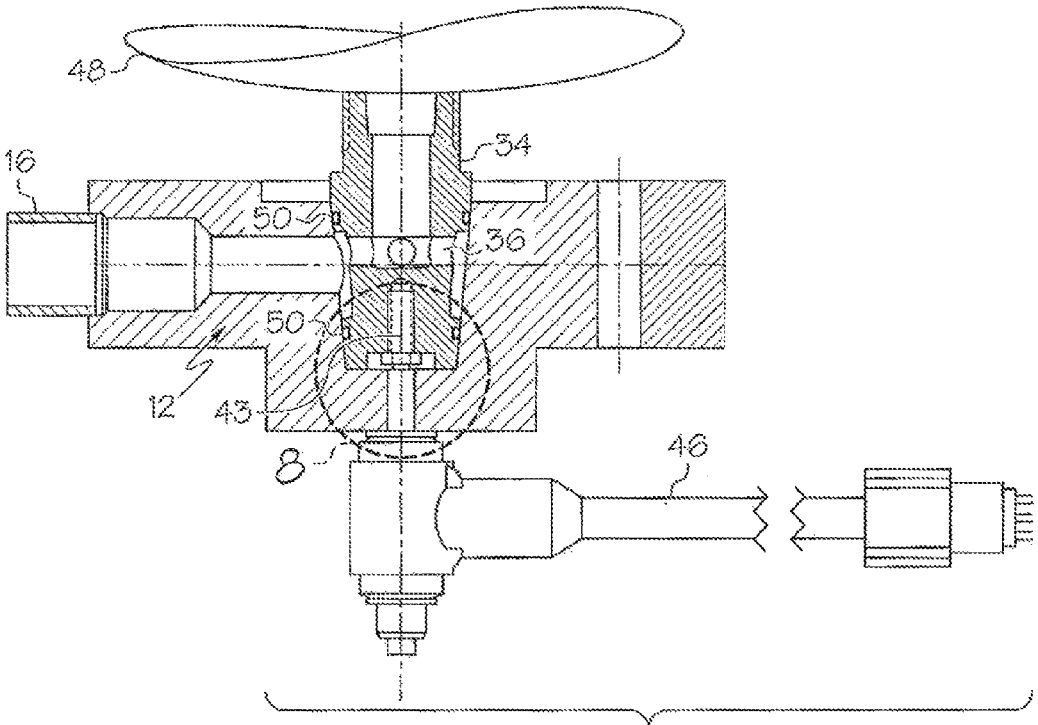
FIG. 7 is a cross-sectional view of the operational portions of the device of FIG. 1.
Figure 8:
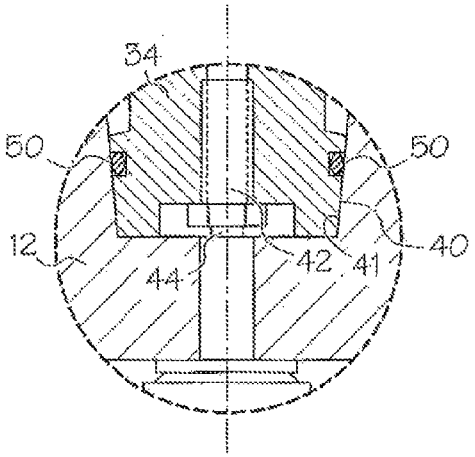
FIG. 8 is an enlarged cross-sectional view taken along line 8-8 of FIG. 7.

FIGS. 6 and 7 can be used to illustrate the aforementioned sacrificial fastener 42 in greater detail. As shown in FIG. 6, sacrificial fastener 42 can include a bolt 43, which can be formed with a notch 44. A voltage source 46 can further be connected in direct contact with bolt 43. In several embodiments, the bolt 43 can be a FRANGIBOLT®, which is manufactured by TiNi Aerospace. The size of the bolt 43 and depth of score 44 can be selected based on the required tensile load the device 10 will be required to withstand. For these embodiments, the applied voltage from source 46 to fastener 43 can be a nominal 28 VDC voltage, which can cause the bolt 43 to expand and fracture at notch 44. As described above and shown in FIG. 6, bolt 43 can be formed with a notch 44 in a specific location to insure a clean break at the defined loading from the voltage supply 46.

FIG. 7 illustrates a configuration wherein the release nose 34 is inserted into conical chamber 30 of disc manifold 12. As shown in FIG. 7, mating surface 40 of release nose 34 can contact chamber surface 41 of disc manifold 12 when release nose 34 is inserted into conical chamber 30. With this configuration, a path of fluid communication can be established from gas supply line 16 through fill passageway 32 and inflation port 36 into the interior 48 of fill bladder 14, to thereby fill the fill bladder. A pair of O-rings 50 can be included above and below the aforementioned path of communication to maintain a watertight seal between release nose 34 and disc manifold 12. Sacrificial fastener 42 (bolt 43) can be passed through a bottom opening in disc manifold 12 and threaded into release nose 34 so that notch 44 is located at an interface between release nose 34 and disc manifold 12.

With the above-described configuration, device 10 can be capable of maintaining a bubble tight seal, even when device 10 is subjected to axial separation loads up to 2500 lbf once fill bladder 14 has been inflated. Device 10 can be especially useful for subsea filling and remote release of large buoyant systems at or below the sea surface. While there exists a variety of autonomous fill and release mechanisms designed for releasing lighter-than-air aerial devices, none have been identified that can withstand the high loads imparted by buoyant interaction of a large gas filled buoyant member which is moored to the sea floor.

Figure 9:
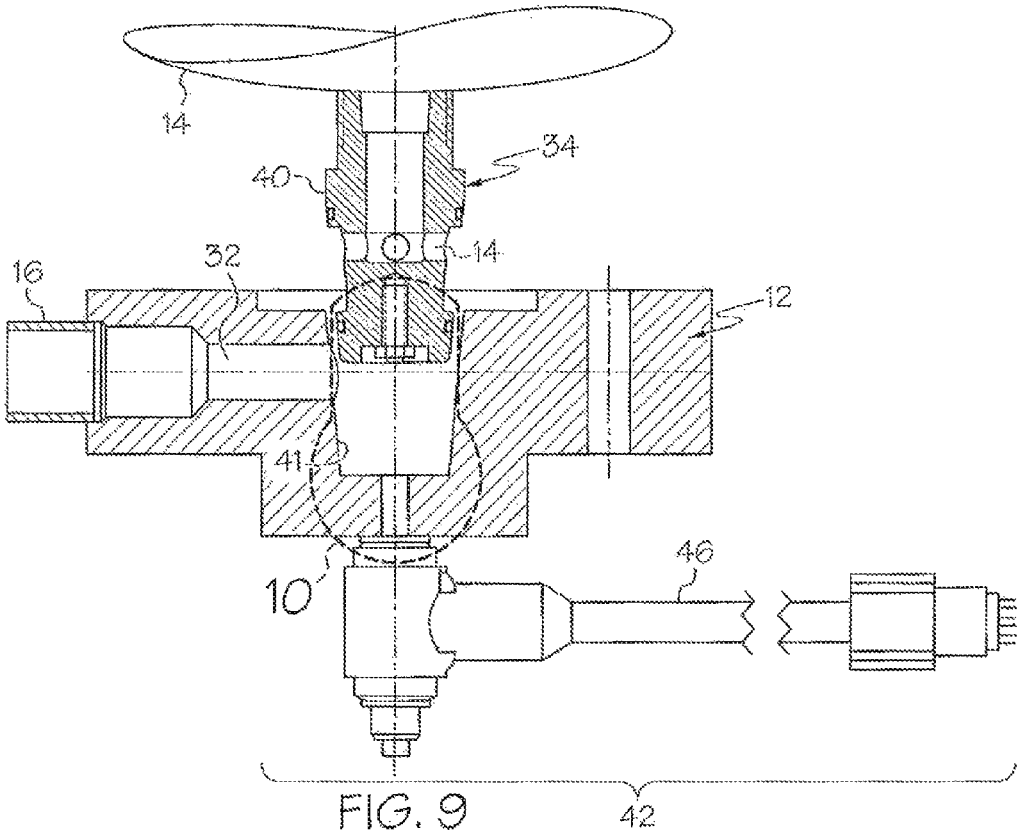
FIG. 9 is the same view as FIG. 7, after remote actuation of the device, just after the release nose has separated from the disc manifold.
Figure 10:
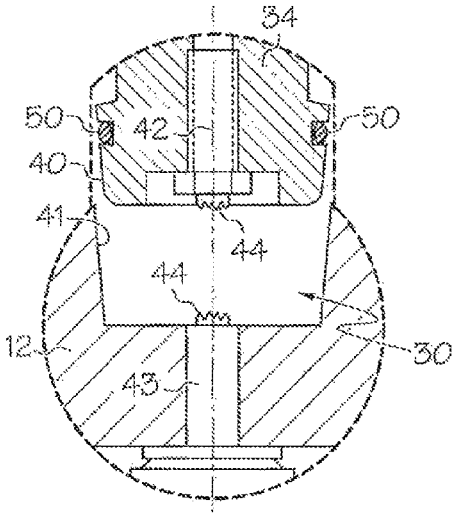
FIG. 10 is an enlarged cross-sectional view taken along line 10-10 of FIG. 7; and, FIG. 11 is a block diagram of steps that can be taken to accomplish the methods of the present invention according to several embodiments.

Referring now to FIGS. 9 and 10, the configuration of device 10 just after deployment can be shown and understood. For the device in FIGS. 9 and 10, voltage source 46 has been activated to apply a 28V DC voltage to the FRANGIBOLT® portion of sacrificial fastener 42, which can expand and selectively fracture at notch 44. Once fastener 42 fractures, the buoyant force due to the fill bladder 14 (which is full) can cause release nose 34 to separate from disc manifold 12. As this occurs, the geometry of release nose 34 and disc manifold 12 can allow for release nose 34 to disengage and separate from chamber surface 41 of conical chamber 30, so that mating surface 40 no longer contacts chamber surface 41. Thus, the activation and release of device 10 can occur without moving parts (other than release nose 34 rising and moving away from disc manifold 12).

From the above, it can be seen that the invention can enable the fill, retention and release of a large volume inflated device, from a gas supply that is moored to the sea floor. The invention can retain the inflated fill bladder 14 during the fill process and can release fill bladder 14 upon command. As described above, the release command for sacrificial fastener 42 can be an applied voltage from voltage source 46 to FRANGIBOLT® bolt 43, to thereby expand and fracture FRANGIBOLT® bolt 43 at a predefined load and location (notch 44). Upon fracture, the release nose 34 can be released from the manifold conical chamber 30 of disc manifold 12, and separation is complete. The advantages of this invention are that it provides the function of filling, retention, and automatic release using a minimal number of components. The system can maintain a bubble tight seal while filling at pressures up to 200 psig and subjected to axial loads up to 2500 lbf. This invention can decouple instantly and can decouple independently of the use of rotational or linear actuators, servos or geared motors.

The system can be adapted to any system that requires fluid transfer and de-coupling while under high tension loads. The system was designed for gas but could easily be adapted for use with liquids. The invention could be useful in any situation where someone may want to decouple a hydraulic or pneumatic interface remotely.

Figure 11:
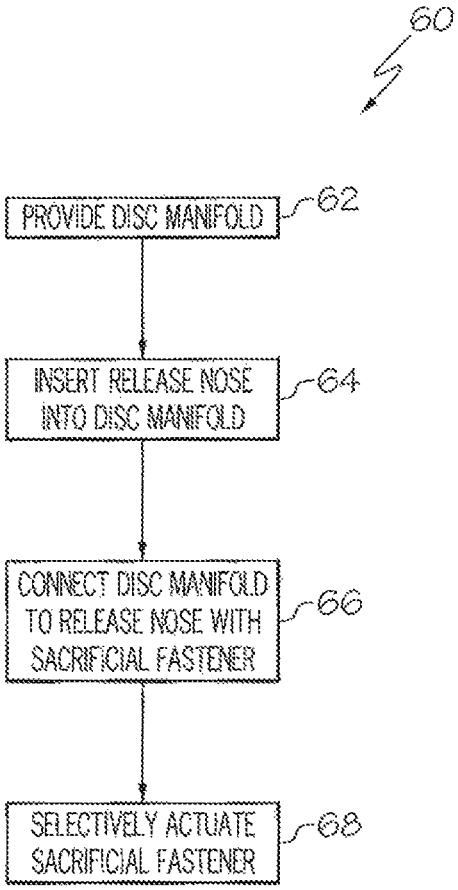

Referring now to FIG. 11, a block diagram 60 is shown, which illustrates steps that can be taken to practice the methods of the present invention according to several embodiments. As shown, method 60 can include the initial step 62 of providing a disc manifold 12, as shown by block 62. The disc manifold 12 can have the structure described above. The methods can further include the step 64 of inserting a release nose 34 into disc manifold 12. The release 34 can have the structure and cooperation of structure as described above.

As also shown in FIG. 11, the methods according to several embodiments can further include the step 66 of connecting the disc manifold to the release nose with a sacrificial faster 42. The FRANGIBOLT® and voltage supply structure described above could be used for this purpose. However, it should also be appreciated that other fasteners could be used, provided the fastener operates to allow for detachment of release nose 34 from disc manifold 12 without requiring any moving parts. Examples can include, but not be limited to, fasteners that can react chemically once exposed to seawater. The methods can also include the step 68 of selectively actuating the sacrificial fastener, using the structure described above.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A device, comprising:

a disc manifold having an upper surface, a lower surface and an outer circumferential surface, said disc manifold being formed with a fill passageway and a conical chamber, said fill passageway extending radially inward from said outer circumferential surface and merging into said conical chamber;

said conical chamber being formed with a maximum diameter proximate said upper surface and having a decreasing taper to a minimum diameter proximate said lower surface;

a release nose inserted into said conical chamber; and, a sacrificial fastener to fix said release nose within said conical chamber; said sacrificial fastener being selectively actuated to detach said release nose from disc manifold without the use of moving parts.

2. The device of claim 1, wherein said sacrificial fastener comprises;

a bolt extending through said disc manifold and being threaded into said release nose, said bolt being formed with a notch; and, a voltage supply for selectively applying a voltage to said bolt, said bolt fracturing at said notch in response to said voltage.

3. The device of claim 1, wherein said conical chamber has a conical surface, wherein said device has a moored configuration wherein said release nose contacts said conical surface.

4. The device of claim 3, wherein said device has a deployed configuration, wherein said release nose does not contact said conical surface and wherein a portion of said bolt remains threaded into said release nose.

5. The device of claim 2, further comprising a compressed gas supply connected to said disc manifold in fluid communication with said fill passageway.

6. The device of claim 1, further comprising a fill bladder in fluid communication with said conical chamber.

7. A device comprising:

a conical release nose;

a disc manifold formed with an opening for receiving said conical release nose and having an outer circumferential surface and being formed with a fill passageway extending radially inward from said outer circumferential surface to said opening; and;

a sacrificial fastener to fix said release nose to said disc manifold; said sacrificial fastener being selectively actuated to detach said release nose from disc manifold without the use of moving parts;

said sacrificial fastener comprising a bolt and a voltage supply for selectively applying a voltage to said bolt, said bolt being formed with a notch and extending through said disc manifold and being threaded into said release nose, said bolt fracturing at said notch in response to said voltage.

8. The device of claim 7, wherein said opening has a conical surface, and wherein said device has a moored configuration wherein said release nose contacts said conical surface.

9. The device of claim 7, wherein said device has a deployed configuration, wherein said release nose does not contact said conical surface and wherein a portion of said bolt remains threaded into said release nose.

10. The device of claim 7, further comprising a compressed gas supply connected to said disc manifold in fluid communication with said fill passageway.

11. A method for deploying a moored floatation device, comprising the steps of:

A) providing a disc manifold, said disc manifold having an upper surface, a lower surface and an outer circumferential surface, said disc manifold being formed with a fill passageway extending radially inward from said outer circumferential surface and merging into a conical chamber oriented perpendicular to said fill passageway;

said conical chamber being formed with a maximum diameter proximate said upper surface and having a decreasing taper to a minimum diameter proximate said lower surface;

B) inserting a release nose inserted into said conical chamber; and,

C) connecting said release nose to said disc manifold with a sacrificial fastener to fix said release nose within said conical chamber; and, D) selectively actuating said sacrificial fastener to detach said release nose from disc manifold without using moving parts.

12. The method of claim 11, wherein said sacrificial fastener comprises a bolt and a voltage supply for selectively applying a voltage to said bolt, said bolt being formed with a notch and extending through said disc manifold and being threaded into said release nose, and wherein said step D) further comprises the step of applying a voltage to said bolt, said bolt fracturing at said notch in response to said voltage.

13. The method of claim 12, wherein said step D) is accomplished so that a portion of said bolt remains threaded into said release nose.

14. The method of claim 11, further comprising the steps of:

E) connecting a fill bladder in fluid communication with said conical chamber;

F) attaching a compressed gas supply to said fill passageway; and, the accomplishment of said step E) and said step F) establishing a path of fluid communication from said compressed gas supply, through said fill passageway, said conical chamber and into said fill bladder.

15. The method of claim 14, wherein said conical chamber has a conical surface, and wherein said floatation device has a moored configuration wherein said release nose contacts said conical surface.

16. The method of claim 15, wherein said floatation device has a deployed configuration, wherein said release nose does not contact said conical surface and wherein a portion of said bolt remains threaded into said release nose.

* * * * *